United States Patent [19]

Tenne

[11] Patent Number: 4,598,768

[45] Date of Patent: Jul. 8, 1986

[54] MULTI-SHELL HEAT EXCHANGER

[76] Inventor: Moses Tenne, 1351 Dubarry, Houston, Tex. 77018, now by change of name from Moise Tenne

[21] Appl. No.: 619,040

[22] Filed: Jun. 11, 1984

[51] Int. Cl.[4] ..... F28F 7/00

[52] U.S. Cl. ..... 165/165; 165/155

[58] Field of Search ..... 165/154, 155, 164, 165

[56] References Cited

U.S. PATENT DOCUMENTS

| | | | |
|---|---|---|---|
| 76,181 | 3/1868 | Fowler | 165/155 |
| 173,856 | 2/1876 | Hayes | 165/155 |
| 1,189,797 | 7/1916 | Deppe | 165/155 |
| 2,218,097 | 10/1940 | Rhodes | 165/155 |
| 3,412,787 | 11/1968 | Milligan | 165/165 |
| 3,828,851 | 8/1974 | Takayasu | 165/165 |

*Primary Examiner*—Sheldon J. Richter

*Attorney, Agent, or Firm*—Gunn, Lee & Jackson

[57] ABSTRACT

A multi-shell heat exchanger is disclosed in the preferred embodiment comprising at least two interconnected spherical shells wherein one shell encloses the other. Tubular connectors connect the shells in spaced relation defining an annular space between the shells for a circulating cooling fluid. A second fluid passage through the shells provides a continuous separate flow path for a circulating fluid to be cooled.

10 Claims, 2 Drawing Figures

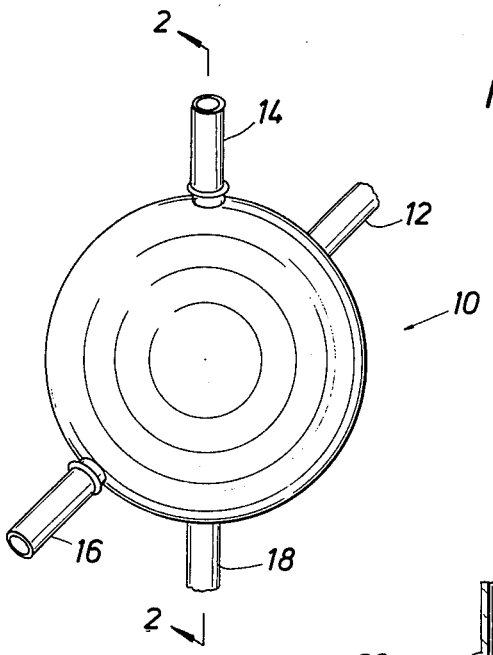
FIG. 1
FIG. 2
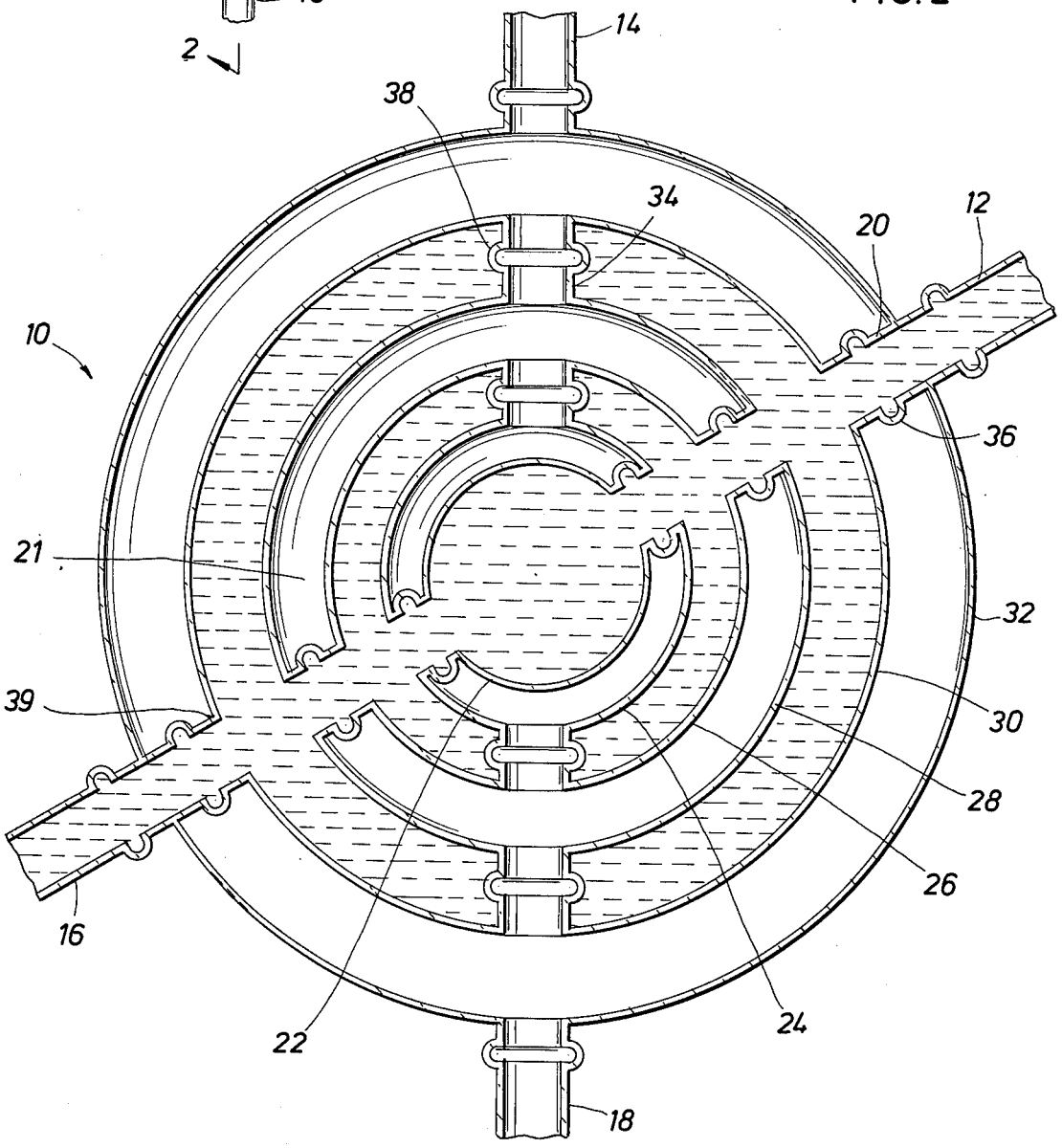

MULTI-SHELL HEAT EXCHANGER

BACKGROUND OF THE DISCLOSURE

This invention relates to a heat exchanger, particularly a multi-shell heat exchanger comprising at least two interconnected spherical shells wherein one shell encloses the other.

Heat exchangers are well known in the prior art and are available in varying sizes and cooling capacities. The design of heat exchangers is often dictated by the intended use of the heat exchanger. Use parameters such as volume, flow rate and temperature differential of the heat exchange media and other variables must be considered in designing a heat exchanger. It is also desirable that heat exchange between fluid media be accomplished in the shortest time possible. In this regard, it has been found that the contact surface area between heat exchange fluid media is directly related to the efficiency of the heat exchanger. Prior art devices have taken various forms to increase the contact surface area between the heat exchange fluid media. Some prior art heat exchangers include very long concentric tubes varying in length from several feet to 20 feet or more. Other prior art devices include a large outer shell with a plurality of small diameter tubes extending through the outer shell. In some prior art devices the small tubes are coiled within the outer shell to increase the surface contact area.

The heat exchanger of this disclosure utilizes a plurality of spherical shells arranged one within the other, the innermost shell being volumetrically the smallest and enclosed by successively larger shells. The spheres provide a maximum surface contact area for the heat exchange media for a given volume of structure. Thus, the heat exchanger of this disclosure provides a maximum cooling area for a given space. Space limitations are an important consideration, particularly in a laboratory where a 10 or 20 foot heat exchanger tube can not be conveniently accommodated. The apparatus of the present disclosure overcomes the problem of space limitation by utilizing a plurality of spherical shells to provide a large cooling contact area for the heat exchange media in the smallest volumetric space.

The temperature differential of the heat exchange media is an important consideration in the design of a heat exchanger. Thermodynamic stress resulting from the temperature difference between the heat exchange media increass proportionally to an increase in temperature differential. The spherical structure of the heat exchanger of this disclosure is well suited to endure thermal shocks resulting from sudden temperature and pressure differences. The spherical construction of the heat exchanger enables the heat exchanger to withsand the greatest thermodynamic stress for a given cooling area.

SUMMARY OF THE DISCLOSURE

The present disclosure is directed to a heat exchanger comprising at least two interconnected spherical shells. One shell is smaller than the other so that it is completely enclosed within the larger shell. Tubular connectors connect the shells in spaced relation so as to define an annular space between the shells. The annular space extends about the total peripheral surface of the inner shell forming a spherical fluid cavity which totally encloses the inner shell. The tubular connectors form at least part of the fluid passages for the circulating heat exchange fluid media. The tubular connectors may be provided with expansion joints to accommodate expansion and contraction of the material forming the heat exchanger resulting from substantial temperature differences between the circulating heat exchange fluid media.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a pictoral representation of the heat exchanger of the invention; and FIG. 2 is a sectional view of the invention taken along the line 2—2 of FIG. 1 showing a preferred embodiment of the invention.

DETAILED DESCRIPTION OF THE PREFERRED EMBODIMENT

Figure 3:
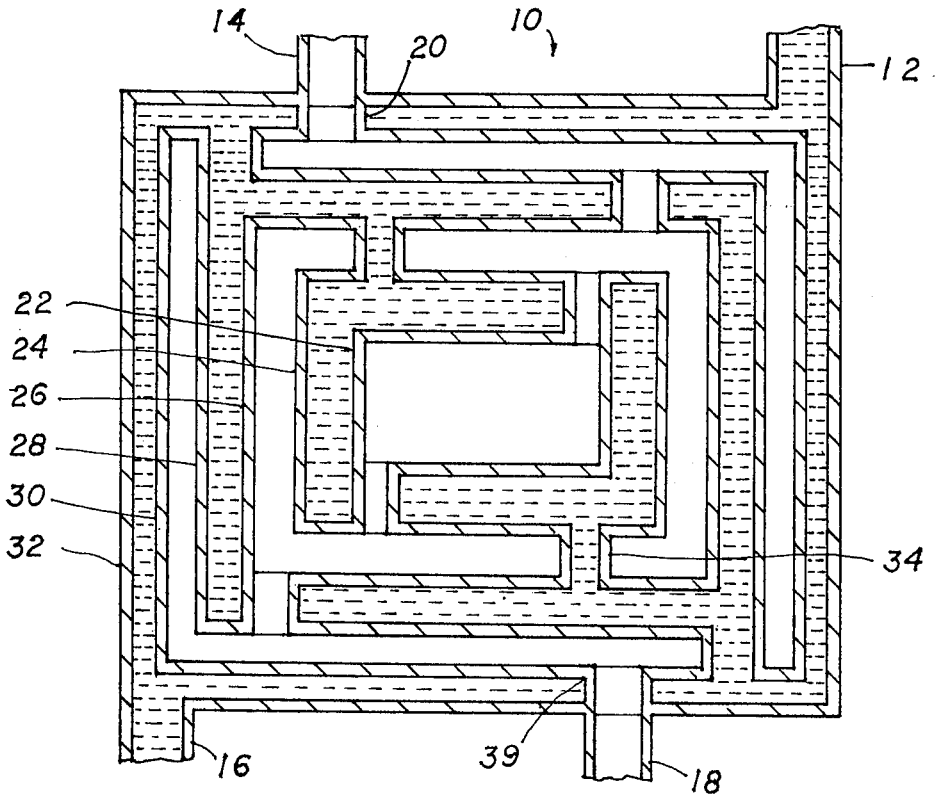
Figure 4:
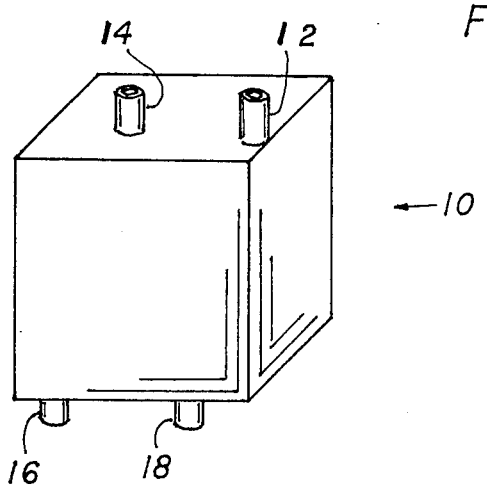
Figure 5:
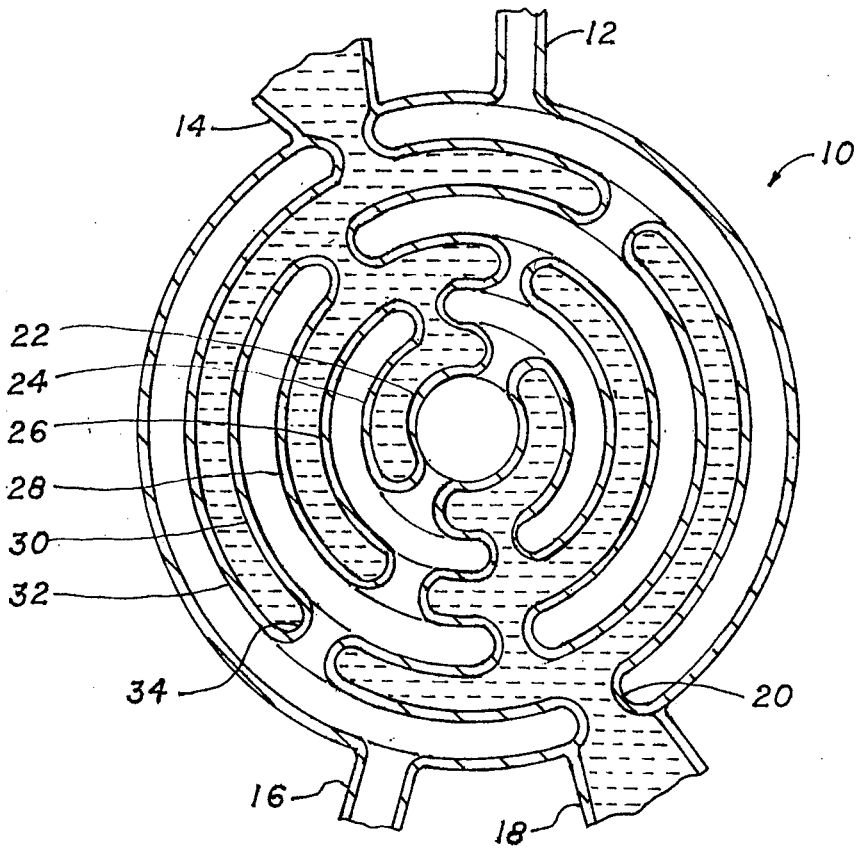
Figure 6:
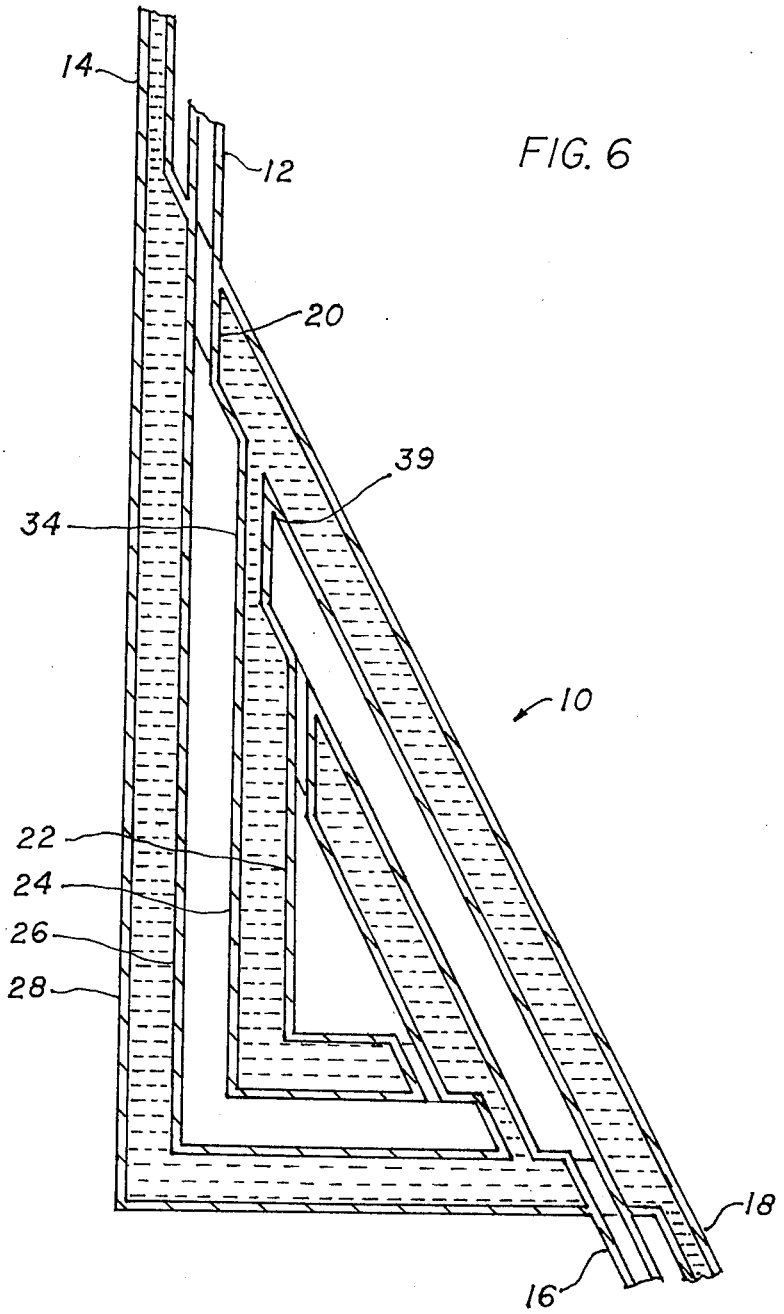

Attention is first directed to FIG. 1 which is a pictoral representation of the apparatus of the present disclosure. The apparatus is generally identified by the reference numeral 10. The apparatus 10 is provided with an inlet and an outlet for the heat exchange fluid media. The direction of fluid flow through the apparatus 10 is immaterial and does not alter the cooling efficiency of the apparatus. For illustrative purposes, however and ease of discussion, the reference numeral 12 designates the inlet for the circulating cooling fluid and the reference numeral 14 designates the inlet of the circulating fluid (hot fluid) to be cooled. Likewise, the numeral 16 identifies the outlet for the circulating cooling fluid and the numeral 18 identifies the outlet for the circulating hot fluid. The terms hot and cool are relative, not absolute terms.

Referring now to FIG. 2, the preferred embodiment of the apparatus 10 is shown. In the preferred embodiment, the apparatus 10 comprises a system of six concentric shells each with a fluid volume. The shells are connected to form two separate fluid volumes within the apparatus 10. Each of the separate volumes being defined by the six interleaved volumes. The shells are interconnected by tubular connectors 20 and 34 which partially form the continuous fluid passages extending through the apparatus 10 providing continuous and separate flow paths for the circulating heat exchange fluid media. The tubular connectors 20 and 34 also maintain the shells in a spaced relationship to define an annular space 21 between adjacent pairs of the shells wherein the spaces completely enclose the smaller internally located shells. The apparatus 10 includes an innermost shell 22 defining an enclosed space therein. The shell 22 is enclosed by successively larger shells 24, 26, 28, 30 and 32. Each successive shell is slightly larger than the smaller shell and defines a space therein.

In the preferred embodiment of FIG. 2, the shells are interconnected in groups of three defining a fluid flow passage through the apparatus 10. The shells 22, 26 and 30 are interconnected by tubular connectors 20 to define a first fluid passage forming a flow path through the apparatus 10 for a circulating cooling fluid. For the sake of clarity, the flow path of the cooling fluid is cross-hatched in FIG. 2. The circulating cooling fluid may be water or any other type of coolant flowing between the inlet 12 and outlet 16.

The second fluid passage through the apparatus 10 is on the interior of the shells 24, 28 and 32 which are interconnected by tubular connectors 34. In particular, the shells 24, 28 and 32 are on the outside of a flow chamber confining the hot fluid in contact with the internal shells for heat transfer.

It will be observed that the fluid passages through the apparatus 10 define two separate fluid volumes within the apparatus 10. The fluid passages are partially formed by the tubular connectors 20 and 34 which alternately connect the annular spaces 21 defined between adjacent shells. Thus, the apparatus 10 defines six temperature strata or zones alternately arranged and separated by the interconnected heat exchange surfaces of the concentric shells forming the apparatus 10. The connectors 20 are drawn in alignment in FIG. 1; this is a convenience to assist in explanation. Actually the two connectors into a fluid zone within a strata are preferably offset from other connectors to enable fluid flow in a circuitous route. The same deployment is desirable for the connectors 34 to offset them.

The tubular connectors 20 and 34 shown in FIG. 2 are provided with expansion bellows 36 and 38, respectively, to accommodate expansion and contraction of the apparatus 10 due to temperature differences in the fluids flowing therethrough. It is understood, however, that the expansion bellows 36 and 38 may be omitted as required by design criteria. If thermal expansion coefficient of the structural material of the apparatus 10 is low, the expansion bellows 36 and 38 may not be necessary. For example, expansion bellows may be desirable for a heat exchanger fabricated of borosilicate glass, but not necessary or desirable if the heat exchanger is fabricated of quartz.

The apparatus 10 may be fabricated of glass, quartz, metal or any other suitable material. In the preferred embodiment shown in FIG. 2, the apparatus 10 comprises six interconnected glass shells. The apparatus 10 may include a greater or fewer number of shells, it requiring only two shells to form two separate fluid volumes separated by an interacting heat exchange surface. Preferably, the shells forming the apparatus 10 are concentrically arranged so that fluid entering the apparatus will tend to flow evenly through the annular spaces 21 forming the flow paths for maximum heat exchange between the circulating fluids. Each annular flow space has two or more connectors into that space. More connectors can be included to enhance fluid flow. Fewer connectors can be used to force flow into a limited channel and thereby extend flow transit time.

The annular spaces 21, as best shown in FIG. 2, successively increase in diameter outwardly from the center of the apparatus 10. Also, the innermost spherical space defined by the shell 22 contains the smallest volumetric space. The next annular space is larger, and the outer space is larger yet. The spherical shells forming the apparatus 10 may be arranged in such a manner so that one or more of the annular spaces 21 enclose substantially equal volumetric spaces. The heat exchange surface separating the hot and cool circulating fluids successively increases from the innermost shell 22 to the outermost shell 32. The heat exchange rate between the circulating fluids is proportional to the total heat exchange surface area separating the fluids. Thus, the successively increasing heat exchange surface area defined by the larger shells forming the apparatus 10 accommodates successively larger volumes of fluid for heat exchange between the circulating fluids throughout the apparatus 10.

For the sake of clarity and ease in preparation of the drawings, the corners 39 as shown in FIG. 2 are depicted forming right angles. In actuality, the corners 39 are smoothly curved, having a radius of curvature of perhaps ¼ inch. Sharp edges are not desirable, particularly if the apparatus 10 is fabricated of glass. Sharp edges form an obstacle to the flow of heat. It is therefore desirable to round the corners 39 thus reducing the effect of thermal shock at the corners 39.

The apparatus 10 shown in FIG. 2 is best suited for use in a laboratory setting wherein the apparatus 10 may be incorporated in a closed loop fluid flow system. The apparatus 10 may be mounted to a tripod or other suitable base positioning the apparatus 10 for connection to the fluid flow system. Alternatively, the outermost shell 32 may be slightly flatened on one side, allowing the apparatus 10 to be self-supporting. The inlet 12 of the apparatus 10 is connected to the coolant flow line and the inlet 14 is connected to the flow line for the fluid to be cooled. For example, the coolant may be water and the heat exchange fluid may be steam vapor which is condensed as it passes through the apparatus 10. The alternating arrangement of the fluid passages through the apparatus 10 permits heat exchange between the water and steam as the two fluids bath around each other as they flow through the annular spaces 21 of the apparatus 10.

While the foregoing is directed to the preferred embodiment of the present invention, other and further embodiments of the invention may be devised without departing from the basic scope thereof, and the scope thereof is determined by the claims which follow.

What is claimed is:

1. A multi-shell heat exchanger, comprising:

(a) a multiplicity of interconnected shells arranged one within the other, said shells including an innermost shell defining an enclosed space therein, said innermost shell being enclosed by a plurality of successively larger shells;

(b) means supporting said shells in spaced relation so as to define annular flow spaces between said shells;

(c) first fluid passage means defined at least in part by connector means forming a first continuous flow path for a cooling fluid circulating through said shells; and (d) second fluid passage means defined at least in part by connector means forming a second continuous and separate flow path for a heated fluid circulating through said shells, said heated fluid being cooled by heat transfer between the heated fluid and the cooling fluid occuring across said shells.

2. The apparatus of claim 1 wherein said supporting means include expansion means permitting said heat exchanger to expand and contract responsive to temperature differences of fluid circulating therethrough.

3. The apparatus of claim 1 wherein said heat exchanger includes alternating temperature zones formed by interconnection of said shells.

4. The apparatus of claim 1 wherein said first and second fluid passage means define separate fluid volumes separated by heat exchange surfaces formed by said shells.

5. The apparatus of claim 4 wherein said interconnected shells are spherical in shape and said heat exchange surfaces are defined by said spherical shells.

6. The apparatus of claim 5 wherein said separate fluid volumes are alternately arranged for maximizing the heat exchange surface area within a specified volumetric space.

7. The apparatus of claim 6 including a separate inlet and outlet for both of said first and second fluid passage means.

8. The apparatus of claim 7 wherein said heat exchanger includes at least six interconnected spherical shells.

9. The apparatus of claim 8 wherein said first fluid passage means defines a continuous and alternative flow path formed by connecting said supporting means and a group of three of said six spherical shells.

10. The apparatus of claim 9 wherein said second fluid passage means defines a continuous and separate flow path formed by connecting said supporting means and a separate group of three of said six spherical shells.

* * * * *